US007373784B2

(12) United States Patent
Haskayne

(10) Patent No.: US 7,373,784 B2
(45) Date of Patent: May 20, 2008

(54) METHODS AND APPARATUS FOR BEER DISPENSING SYSTEMS

(75) Inventor: Paul Haskayne, Lower-Peover (GB)

(73) Assignee: Lancer Partnership Ltd., San Antonio, TX (US)

( * ) Notice: Subject to any disclaimer, the term of this patent is extended or adjusted under 35 U.S.C. 154(b) by 497 days.

(21) Appl. No.: 11/040,153

(22) Filed: Jan. 21, 2005

(65) Prior Publication Data

US 2006/0162370 A1 Jul. 27, 2006

(51) Int. Cl.
*B67D 5/26* (2006.01)
*F25D 17/02* (2006.01)

(52) U.S. Cl. ..... 62/201; 62/390; 62/396; 222/146.6

(58) Field of Classification Search ..... 62/185, 62/201, 390, 393, 396; 222/146.6
See application file for complete search history.

(56) References Cited

U.S. PATENT DOCUMENTS

| | | | | |
|---|---|---|---|---|
| 2,362,104 | A | 11/1944 | Smith | |
| 4,676,400 | A * | 6/1987 | Lamont et al. | 222/1 |
| 4,949,552 | A * | 8/1990 | Adams | 62/196.4 |
| 5,009,082 | A | 4/1991 | Abraham, III | |
| 5,502,978 | A * | 4/1996 | Field | 62/157 |
| 5,732,856 | A * | 3/1998 | Fry | 222/146.6 |
| 5,896,748 | A | 4/1999 | Park | |
| 5,970,732 | A | 10/1999 | Menin et al. | |
| 6,164,083 | A * | 12/2000 | Leeming et al. | 62/393 |
| 6,598,417 | B1 * | 7/2003 | Wilkes | 62/390 |
| 6,681,841 | B1 * | 1/2004 | Dale | 165/47 |

FOREIGN PATENT DOCUMENTS

| | | |
|---|---|---|
| DE | 21 55 758 B | 4/1999 |
| EP | 1 380 536 A1 | 1/2004 |
| EP | 1 502 897 A1 | 2/2005 |
| GB | 2 146 705 A | 4/1985 |
| WO | WO 98/42613 A2 | 10/1998 |
| WO | WO 98/42613 A3 | 10/1998 |
| WO | WO 02/40179 A2 | 5/2002 |
| WO | WO 02/40179 A3 | 5/2002 |

OTHER PUBLICATIONS

European Search Report from European Patent Office in foreign counterpart application of this application.

* cited by examiner

*Primary Examiner*—Marc Norman

(57) ABSTRACT

A multiple-temperature beer dispensing system (10) (and related methods) is provided in which a plurality of beer sources (12) are coupled to a plurality of taps (16). Heat exchangers (18) may be disposed between one or more of the beer sources (12) and one or more of the taps (16). Beer temperatures may be controlled with a controller (30), sensors (32) and valves (34). Also provided is system (50) that allows a single tap (16*n*) to dispense beer at more than one temperature. Also provided is a controlled temperature storage chamber (100) and a tube bundle (70).

11 Claims, 3 Drawing Sheets

FIG. 4
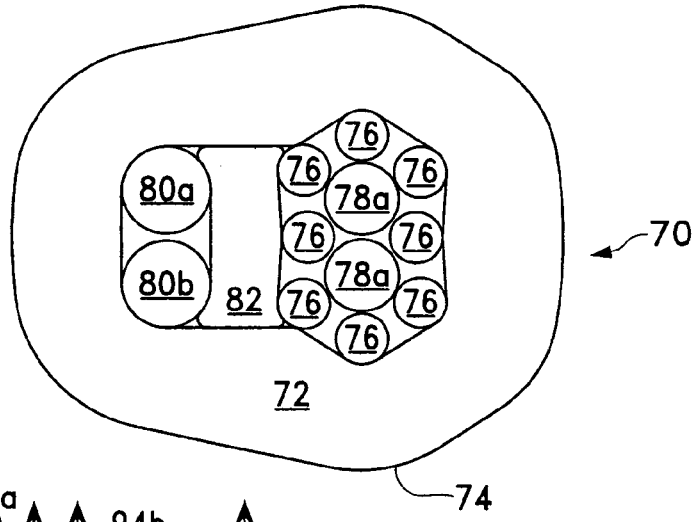
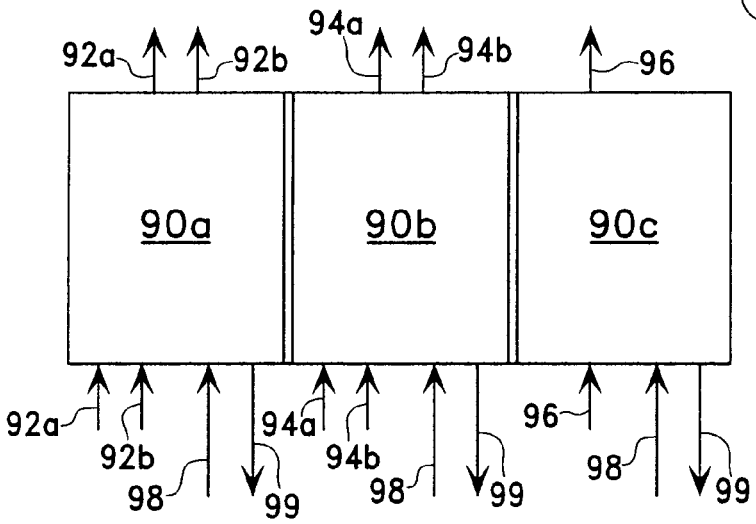
FIG. 5
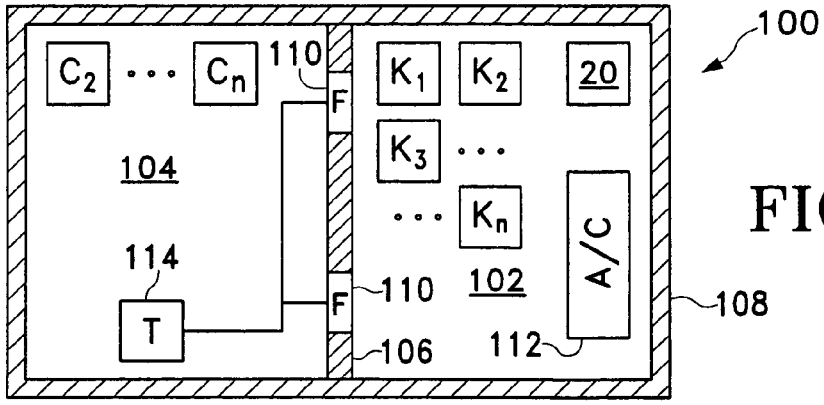
FIG. 6
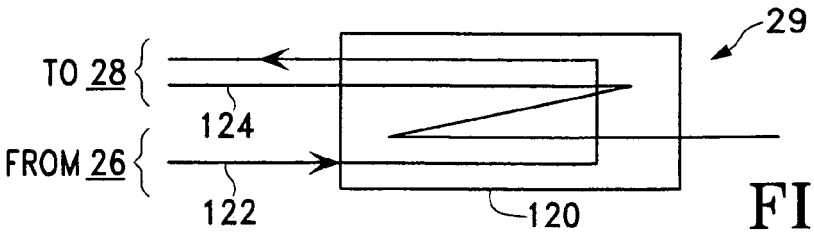
FIG. 7

METHODS AND APPARATUS FOR BEER DISPENSING SYSTEMS

TECHNICAL FIELD OF THE INVENTION

This invention relates generally to beverage systems, and more particularly to methods and apparatus for beer dispensing systems.

BACKGROUND OF THE INVENTION

Not every beer should be dispensed at the same temperature, either because of the preference of the beer drinkers or the specifications of the beer brewers. However, efforts to accommodate different dispensing temperatures, for example at a pub, have often been piecemeal, expensive, and unreliable. Therefore, a need has arisen for methods and apparatus for beer dispensing systems which allow different beer dispensing temperatures and which overcome the limitations of prior art systems.

SUMMARY OF THE INVENTION

In accordance with the teachings of the present invention, methods and apparatus for a beer system are provided which eliminate or substantially reduce the problems associated with prior art systems.

In one embodiment, a beer system is provided that includes a plurality of beer sources, a coolant chiller for chilling coolant, and a plurality of beer taps for dispensing beer. A heat exchanger is coupled between at least one of the beer sources and at least one of the beer taps, and coupled to the coolant, and is operable to chill the beer from the coupled beer source before it reaches the beer tap. Also, a sensor is used for measuring the temperature of the beer chilled by the heat exchanger, and a valve controls flow of coolant to the heat exchanger in response to the sensor. In particular embodiments, the sensor may be a thermocouple, and the heat exchanger may be a cold plate, such as one cooled by a heat transfer fluid flowing through the cold plate.

In another embodiment, a beer system is provided that includes a plurality of beer sources and a coolant chiller for chilling coolant that is split into at least a first coolant line and a second coolant line, wherein the first coolant line is coupled to a first coolant valve for controlling flow of coolant in that line. A plurality of beer taps for dispensing beer are provided, wherein at least one of the beer taps is for dispensing beer within a first temperature range, this first temperature range tap being coupled to at least one of the beer sources. A first sensor is used for measuring the temperature of the beer to be dispensed by the first temperature range tap, and the sensor provides a signal for use in controlling the first coolant valve. Also, at least one of the beer taps is for dispensing beer within a second temperature range, this second temperature range tap being coupled to a heat exchanger, the heat exchanger coupled between at least one of the beer sources and the second temperature range tap. The heat exchanger is operable to chill the beer from the coupled beer source before it reaches the second temperature range tap. A second sensor is used for measuring the temperature of the beer chilled by the heat exchanger, and a second coolant valve coupled to the second coolant line between the coolant chiller and the heat exchanger is used for controlling flow of coolant to the heat exchanger, the second coolant valve controlled in response to the second sensor. In particular embodiments, the sensor may be a thermocouple, and the heat exchanger may be a cold plate, such as one cooled by a heat transfer fluid flowing through the cold plate.

Also, a beer system is provided in which a first beer line and a second beer line are both supplied with one beer brand, and a heat exchanger is coupled to the first beer line for chilling the beer in the first beer line to a temperature within a first temperature range. A beer tap is provided for dispensing beer from either of the two beer lines, and a selector is used for selecting which of the two beer lines supplies the beer tap. In a particular embodiment, a three-way valve is provided that has two inputs and one output, wherein one input is coupled to the first beer line downstream of the heat exchanger, the other input is coupled to the second beer line, and the output is coupled to the beer tap. The valve is controlled in response to the selector. In particular embodiments, the selector may be a switch, and the heat exchanger may comprise a heat exchanger cooled with a coolant. Also, a coolant valve may be provided for controlling flow of a coolant to the heat exchanger. Furthermore, the second beer line may be coupled to the heat exchanger for chilling the beer in the second beer line to a temperature within a second temperature range. At least part of the heat exchanger may be located within a beer font.

Also provided is a beer system that includes a plurality of beer sources supplying respective beer lines, a coolant chiller for chilling coolant, the chilled coolant being split into at least a first coolant line and a second coolant line, a plurality of beer taps for dispensing beer from the beer sources, and an insulated bundle carrying the beer lines and the first and second coolant lines. Within the insulated bundle, the beer lines and the first coolant line may run in a sub-bundle, and the second coolant line may be spaced apart from the sub-bundle. The second coolant line may be separated from the sub-bundle by an insulator.

Also provided is a controlled temperature storage chamber that includes a first section for storing a first plurality of beer sources, the first section including an air cooler, the air cooler for maintaining the air temperature of the first section within a first temperature range. A second section is provided for storing a second plurality of beer sources, the second section being at least partially separated from the first section by a partition, and wherein the partition includes a fan operable to blow air from the first section into the second section when the fan is on. A temperature sensor in the second section senses the air temperature of the second section, and the fan is turned on in response to the temperature sensor to maintain the air temperature of the second section within a second temperature range. In a particular embodiment of the chamber, the first temperature range may be about 6 degrees Celsius to about 8 degrees Celsius, and the second temperature range may be about 11 degrees Celsius to about 13 degrees Celsius.

Important technical advantages are provided herein, including, without limitation, the ability to effectively dispense beer at multiple temperatures through the use of temperature sensing and automatic control of coolant flow. In another aspect of the present invention, an important technical advantage is the ability to dispense beer at more than one temperature through one tap. Also, various aspects discussed herein can significantly reduce complexity and installation costs in beer systems, while at the same time improving reliability. The present invention allows for versatile, customizable beer systems that easily accommodate multiple beer temperatures, thus offering greater opportunities for the owner of the system.

BRIEF DESCRIPTION OF THE DRAWINGS

Reference is made in the description to the following briefly described drawings, wherein like reference numerals refer to corresponding elements:

FIG. 4 illustrates one embodiment of a tube bundle according to one aspect of the teachings of the present invention;

FIG. 5 illustrates one embodiment of a gang of heat exchangers according to one aspect of the teachings of the present invention;

FIG. 6 illustrates one embodiment of a cold chamber according to one aspect of the teachings of the present invention; and FIG. 7 illustrates one embodiment of an in-line pre-chilling heat exchanger according to one aspect of the teachings of the present invention.

DETAILED DESCRIPTION OF THE INVENTION

Figure 1:
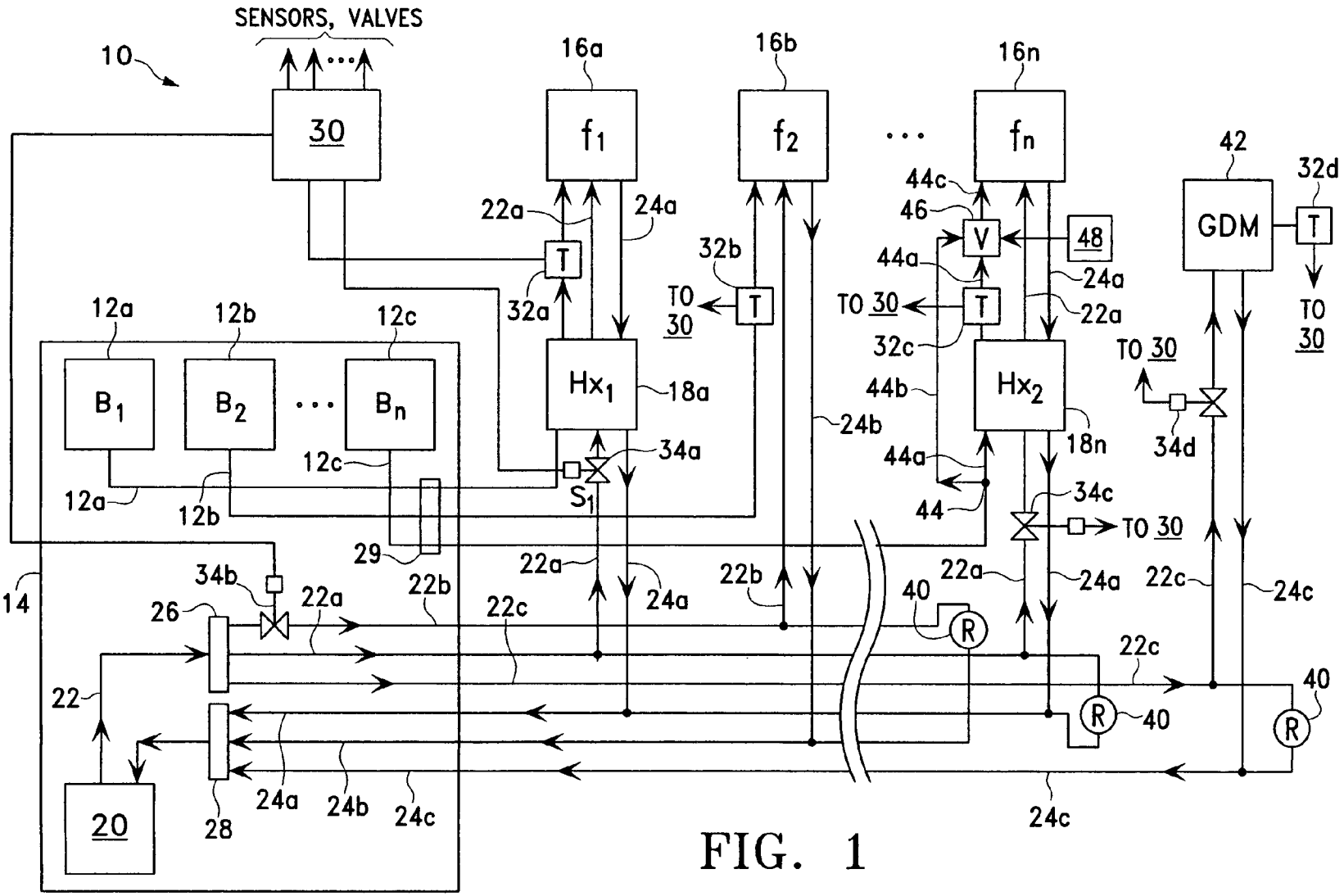
FIG. 1 is a schematic of one embodiment of a beer system according to one aspect of the teachings of the present invention.

As shown in FIG. 1, beer system 10 includes a plurality of beer sources 12 (12*a*, 12*b*, 12*c*) located within a cold room 14. Although beer sources 12 are usually kegs or casks, any beer source may be used. The beer sources 12 are shown in a cold room 14, although they need not be in a dedicated chamber. The beer sources 12 are coupled to a plurality of beer taps 16, usually through a pumping or gas pressure delivery system (not shown). The beer taps 16 are often fixed to beer fonts, and the taps may be, for example and without limitation, mechanical or solenoid-operated taps. Some of the beer sources 12 are coupled to the beer taps 16 through heat exchangers 18, which are used to chill the beer. In a particular embodiment, heat exchangers 18 are cooled by a coolant chilled by a coolant chiller 20. Coolant chiller 20 may, without limitation, chill coolant through use of a mechanical refrigeration system.

Coolant from the coolant chiller 20 is recirculated (for example by pumping) through the system 10, through flow line 22 and return line 24. As shown, flow line 22 may be split, for example through a manifold 26, into a plurality of flow lines, such as 22*a*, 22*b*, and 22*c*. Similarly, the return line 24 may be fed through a manifold 28, to which return lines 24*a*, 24*b*, and 24*c* are coupled. The coolant may be any coolant suitable for the application, for example, and without limitation, water, glycol, or any heat transfer fluid.

Coolant lines 22*a* and 22*b* are used in chilling or maintaining beer temperatures within desired ranges. As shown, coolant line 22*a* flows to heat exchangers 18*a* through 18*n*, which are used to chill beer down to desired temperature ranges. Such chilling is required where the temperature of the beer from the beer sources (or from optional pre-cooler 29, which may be, without limitation, a coolant bath, cold plate, or other heat exchanger) is not as low as is desired for the dispensing temperatures. Coolant line 22*b* runs in close proximity to beer lines 12 helping to maintain the temperature of the beer, and runs toward the beer tap 16*b*.

A controller 30 is provided for setting each temperature desired for each tap 16. It is preferred that one controller be used to make all settings, however, multiple controllers could be used. Controller 30 is preferably located at the bar where beer is dispensed, and is operated by selecting the beer tap to be set, and setting the desired temperature for that tap. Controller 30 operates to control the temperature to the desired range by measuring temperature though sensors 32, and then controlling valves 34 to control the flow of coolant. Without limitation, controller 30 may include a microcontroller or other microprocessor-based circuitry and software, or simple control circuitry, to perform its control functions.

For example, sensor 32*a*, which may be, without limitation, a thermocouple, is used to measure the temperature of beer downstream of heat exchanger 18*a*. Controller 30 reads the sensor 32*a*, and then operates valve 34*a* to control the flow of coolant to the heat exchanger 18*a*. Thus, for example, if the beer temperature is within the desired range, valve 34*a* may be closed by the controller 30. If the beer temperature is too warm, the valve 34*a* may be opened until the temperature is within the desired range. In a particular embodiment, valve 34*a* is a solenoid, on/off valve. However, other valves, such as, without limitation, proportional flow control valves, may be used. The controller 30 may also be used to periodically (at pre-set intervals) open the valves 34 to ensure that beer in the heat exchangers 18 or elsewhere in the system are maintained cold, for example in periods of non-use. However, no such periodic opening may be needed, as the sensors 32 would trigger the controller 30 to increase flow of coolant as beer warms, for example in times of non-use.

Where the temperature of beer to be dispensed is the same as or near the temperature of the beer sources (or as cooled through pre-cooler 29), such as is shown at tap 16*b*, no heat exchanger 18 is necessary. To maintain the temperature of the beer flowing to such a tap, the coolant line 22*b* runs in close proximity to the beer lines 12, continuing toward the tap 16*b*. The beer temperature may be maintained at the proper temperature at or near the tap with any suitable approach, including, without limitation, by trace cooling (wherein the coolant line runs to the tap in close proximity to the beer line, and begins its return route near the tap), by flowing the coolant into a recirculation block at the tap, or by flooding the font with coolant (through which the beer line runs toward the tap), or any combination thereof. A valve 34*b* is coupled to the coolant line 22*b* to control the temperature of the beer dispensed though taps such as tap 16*b*, where no heat exchanger 18 is used. Similarly to the control scheme described above, controller 30 controls the valve 34*b* in response to sensor 32*b* sensing beer temperature.

Also, it should be understood that beer flowing to the heat exchangers 18 may also run in close proximity to any of the coolant lines 22. In particular, as will be discussed, it is preferred that they run in close proximity to coolant line 22*b*. Furthermore, to maintain the beer temperature between heat exchangers 18 and their associated beer taps 16, coolant may flow from a coolant line toward such taps. As discussed above, any suitable approach may be used, including, without limitation, trace cooling, flowing the coolant into a recirculation block at the tap, or by flooding the font with coolant, or any combination thereof. In a preferred embodiment, the coolant line 22*a*, either directly or through the associated heat exchanger 18, is used to maintain the beer temperature between the heat exchanger 18 and the associated beer tap 16.

To ensure that coolant flows into the heat exchangers 18 and toward the taps when appropriate, and to ensure proper recirculation of coolant, pressure regulators or pressure differential valves 40 (without limitation) are included between the coolant flow lines 22 and coolant return lines 24.

In general, with the system described above, heat exchangers 18 are used for beer that is to be dispensed at temperatures below that of the beer leaving the beer sources (or pre-cooler 29). For each such beer, the desired temperature is set with controller 30, which in turn controls the appropriate valve 34 (valve 34*a* or 34*c* in the illustrated example). For beer that is to be dispensed at or near the temperature of beer leaving the beer sources (or pre-cooler 29), the desired temperature is set with controller 30, which in turn controls valve 34*b*.

Following is an example of various temperatures that may be involved in a beer system as described herein. It should be understood, however, that this example is illustrative only, and without limitation. Many other and temperatures may be involved. Ideally, the cold room 14, which is often a cellar, would be maintained in the range of about 6° to about 8° Celsius. Thus, the beer in the beer sources 12 would be in that same range. If the cold room 14 temperature is warmer than desired, the pre-cooler 29 may be used to pre-cool the beer to the desired range. The coolant chiller 20 may be set to chill the coolant to the range of about −3° to about 0° Celsius. Beer to be dispensed at tap 16*b* is to be dispensed at a temperature in the range of about 6° to about 8° Celsius. Beer to be dispensed at tap 16*a* is to be dispensed at a temperature of about 3° Celsius. Beer to be dispensed at tap 16*n* is to be dispensed at a temperature of about 1° Celsius (and, as will be discussed below, also at about 6° Celsius). Controller 30 is used to set those desired dispensing temperatures at each tap 16, and the controller then controls the various valves 34 to achieve the desired temperatures.

Ideally, the heat exchangers 18 are located under the bar at which the taps are located. Because space under such bars is valuable, it is preferred that the heat exchangers be small, although they need not be. With the present invention, individual heat exchangers may be used for each tap that requires one, or, where one temperature is suitable for more than one tap, a heat exchanger that accommodates more than one beer line may be used. Also, combinations of such individual and shared heat exchangers may be used, depending on the requirements of the particular installation. Although it is preferred to locate the heat exchangers 18 near the taps 16, the heat exchangers 18 may be located anywhere, including, without limitation, in the cold room or cellar of the installation.

The use of temperature sensing and automatic control of coolant flow can significantly reduce complexity and installation costs, while at the same time it can improve reliability. The present invention allows for versatile, customizable beer systems that easily accommodate multiple beer temperatures, thus offering greater opportunities for the owner of the system.

Also shown in FIG. 1 is a glass door merchandiser 42. Very often such merchandisers are found in bar installations, but have significant limitations. For example, each such merchandiser usually includes its own mechanical refrigeration system, which increases cost, and which generates heat behind the bar. With the system shown in FIG. 1, the glass door merchandiser 42 may be configured to be cooled by coolant from line 26*c* (or any of the other coolant lines). For example, as is known, the merchandiser 42 may include a heat exchanger supplied by the coolant in the coolant line 26*c*, across which air is blown to be cooled. The temperature of merchandiser 42 may be controlled within a desired temperature range through the use of sensor 32*d*, valve 34*d*, and controller 30, in a scheme as described above. The sensor 32*d* is located inside the merchandiser 42. The illustration of glass door merchandiser 42 is exemplary only, and any device that requires cooling may be cooled by the coolant from coolant chiller 20.

Another aspect of the present invention (illustrated in FIGS. 1 and 2) is an apparatus that includes a single tap 16*n* for dispensing beer at at least two different temperatures. This aspect of the invention may be integrated into some or all of the system illustrated in FIG. 1, or exist as a stand-alone apparatus. Thus, it may be integrated with sensor 32*c* and valve 34*c*, or used without such controls.

Figure 2:
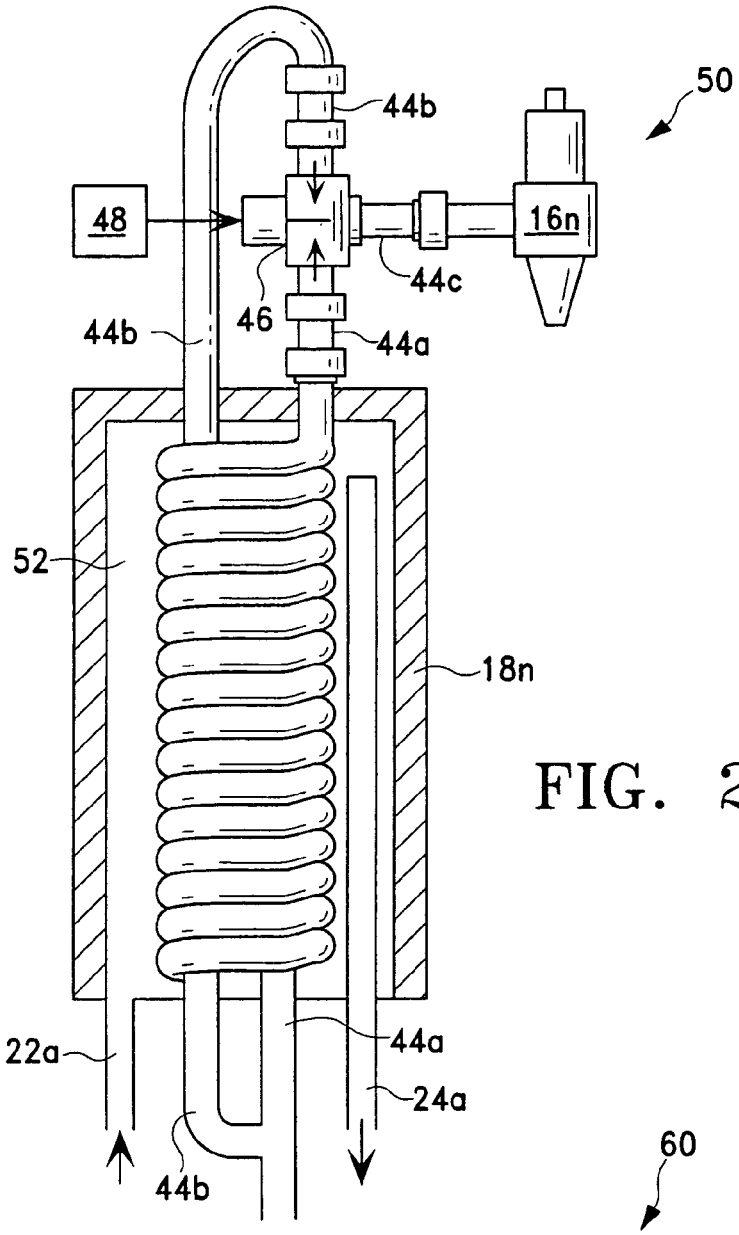
FIG. 2 illustrates one embodiment of a multi-temperature tap according to one aspect of the teachings of the present invention.

To allow such multiple temperature dispensing at tap 16*n*, the beer line 12*c* is split at split point 44 (which may be, without limitation, a two way divider), with one of the split lines 44*a* passing through heat exchanger 18*n* for chilling. As shown in FIG. 2, line 44*a* may. be coiled to allow an elongated run through the heat exchanger 18*n*, thus providing more chilling. The other split line 44*b* may pass outside of the heat exchanger 18*n*, or it may pass through the heat exchanger 18*n* less circuitously than line 44*a*. Thus, downstream of heat exchanger 18*n*, the beer in line 44*a* is colder than the beer in line 44*b*. Although the splitting of beer line 12*c* is shown outside of heat exchanger 18*n*, it could occur within the heat exchanger.

Lines 44*a* and 44*b*, downstream of heat exchanger 18*n*, are input to valve 46. Valve 46 is a three-way valve, having two inputs that are selectively output through one output to line 44*c*. The input line to be output to line 44*c* is selected by selector 48, which is coupled to valve 46. Selector 48 is operated by a user (such as a bartender) to select the beer temperature of the beer to be dispensed. Selector 48 may be, without limitation, a simple switch.

As discussed, the multiple temperature dispensing apparatus (one embodiment being shown as reference 50 in FIG. 2) may be integrated with sensor 32*c* and valve 34*c*, thus allowing for the temperature of the beer to be controlled via controller 30. In most such cases, the sensor 32*c* would be coupled to sense beer temperature in line 44*a*. However the temperature sensing could be used for beer in line 44*b*, or lines 44*a* and 44*b*. Where temperature in only one line is sensed, the other temperature may be set by design, so that the temperature differential is a relatively known value. Also, such temperature sensing is not required, and the temperatures of the beer may be set by proper design of the heat exchanger 18*n* for the particular system, or by setting the amount of coolant flow during installation (such as, without limitation, through a flow control valve) to achieve the desired temperatures.

As shown in FIG. 2, beer line 44*b* runs through the heat exchanger 18*n*. However, as discussed above, beer line 44*b* may run outside of the heat exchanger 18*n*. Also, as shown in FIG. 2, heat exchanger 18*n* may be a flooded chamber type heat exchanger, wherein the coolant flows from line 22*a* into a chamber 52 that includes the coiled line 44*a* (and 44*b* if it runs inside the heat exchanger). The coolant exits though return line 24*a*. Of course, any suitable type of heat exchanger could be used, including, without limitation, cold plate type heat exchangers or brazed plate heat exchangers.

Furthermore, the heat exchanger 18*n* may be integrated (wholly or partly) into a font. Thus, the font could house, and even provide the outer wall, of the heat exchanger 18*n*.

Moreover, to maintain the beer temperatures between heat exchanger 18*n* and beer tap 16*n*, coolant may flow from coolant lines toward the tap. As discussed above, any suitable approach may be used, including, without limitation, trace cooling, flowing the coolant into a recirculation block at the tap, or by flooding the font with coolant, or any combination thereof.

Toggling of the selector 48 during a dispense allows a beer to be dispensed at temperatures between that of the temperatures of beer in lines 44*a* and 44*b*, by mixing beer from lines 44*a* and 44*b* in proportion to the toggling. This allows dispensing at multiple temperatures. Also, a controller, such as controller 30, may be used to automatically accomplish such toggling or modulation for controllably setting such intermediate temperatures. In such case, a selector allowing multiple temperatures (for example, and without limitation, a dial or multiple switches) would be operated by the user and read by the controller 30, which would then control the valve 46. Also, although two lines 44*a* and 44*b* and a three-way valve 46 are illustrated, more than two lines, along with valving and a selector accommodating such multiple lines into a single output, may be used to allow beer at more than two temperatures to be dispensed from a single tap.

Figure 3:
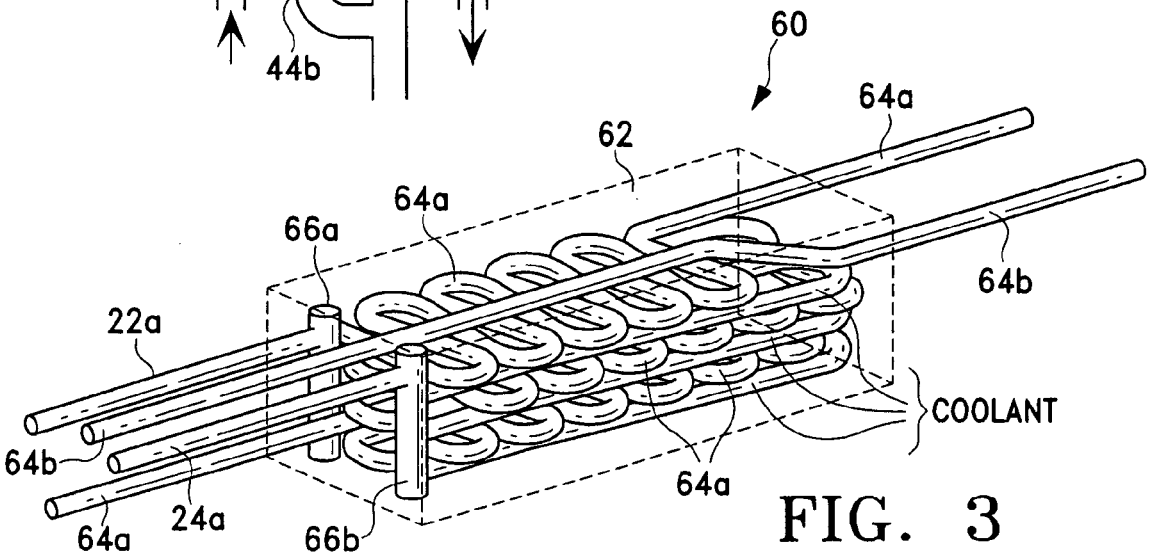
FIG. 3 illustrates one embodiment of a heat exchanger according to one aspect of the teachings of the present invention.

FIG. 3 illustrates a heat exchanger 60 that may be used for one or more of the heat exchangers 18 in FIGS. 1 and 2. It should be understood, however, that heat exchanger 60 is exemplary only, and any other suitable heat exchanger could be used. Heat exchanger 60 is a cold plate type heat exchanger, which is formed by casting a metal 62, such as, without limitation, aluminum, around fluid lines. A coolant flows into the heat exchanger 60 though line 22*a*, and returns though line 24*a*. The coolant cools the metal 62, which in turn causes the fluid (beer) in lines 64*a* and 64*b* to be cooled. Although two beer lines 64*a* and 64*b* are illustrated, only one beer line, or more than two beer lines, may be used. In the particular embodiment shown in FIG. 3, line 44*a* has a longer length within the heat exchanger 60 than line 44*b*, and thus beer exiting the heat exchanger 60 in line 44*a* is colder than that in line 44*b*. However, both lines could have similar lengths. A coolant inlet manifold 66*a* is shown inside of heat exchanger 60, from which multiple coolant lines flow. The coolant lines are returned to coolant return line 24*a* through a return manifold 66*b*. The use of manifolds 66*a* and 66*b* allows even coolant flow distribution within the heat exchanger 60, thus providing efficient cooling. However, it should be understood that no such manifolds are needed, and coolant flow may be distributed through any approach, including, without limitation, clips, or single line flow.

As one example, beer in lines 64*a* and 64*b* may correspond to beer in lines 44*a* and 44*b* of FIGS. 1 and 2. Alternatively, heat exchanger 60 may correspond to heat exchanger 18*a* in FIG. 1, and beer in beer line 64*a* may flow to tap 16*a*. In this latter case, no beer line 64*b* need be used. As another alternative, the beer in line 64*b* may be used to supply beer to tap 16*b*. As another example, with a heat exchanger having two beer lines each of about the same length, the beer lines may supply two taps though which beer is dispensed at about the same temperature.

The heat exchangers shown in FIG. 1 need not all be of the same kind, and it should be understood that, although it is preferred that uniform components be used in the system 10, non-uniform components may be used.

FIG. 4 illustrates a sectional view of a tube bundle 70, often referred to as a python, which may be advantageously used with beer systems. The tube bundle 70 is a bundle of tubes, separated by an insulator 72 from an outer wall 74. Outer wall 74 may be, without limitation, a plastic coating or adhesive sheath. A plurality of beer lines 76, which may correspond to the beer lines 12 shown in FIG. 1, are arranged in a sub-bundle along with and around coolant flow and return lines 78*a* and 78*b*, which may correspond, respectively, to coolant flow line 22*b* and coolant return line 24*b*. Coolant flow and return lines 80*a* and 80*b*, which may correspond to coolant flow and return lines 22*a* and 24*a*, respectively, arc separated by insulator 82 from the lines 76 and 78*a* and 78*b*.

In a particular embodiment, coolant flow line 78*a* corresponds to coolant flow line 22*b*, and is used to transmit coolant and to aid in maintaining beer temperature within lines 76. Coolant flow line 80*a*, which may correspond to coolant flow line 22*a*, transmits coolant to the heat exchangers 18 in FIG. 1. Because coolant flow rates in line 80*a* may be greater than in 78*a*, it is separated from beer lines 76 to prevent over-chilling of those beer lines. Although lines 80*a* and 80*b* are shown with greater diameters than those of lines 76 and 78, they may be of the same diameter, or of a smaller diameter.

With tube bundle 70, installation costs and complexity are reduced, as one tube bundle may be used in place of more than one bundle.

FIG. 5 illustrates a plurality of heat exchangers 90*a*, 90*b*, and 90*c* ganged together for orderly installation and space savings. The particular arrangement is exemplary only, and illustrates heat exchangers 90*a* and 90*b* each accommodating two beers (beer lines 92*a* and 92*b*, and beer lines 94*a* and 94*b*), and heat exchanger 90*c* accommodating one beer line (beer line 96). Coolant flow and return lines 98 and 99 may correspond to lines 22*a* and 24*a* of FIG. 1.

FIG. 6 illustrates a cold room 100 according to one aspect of the present invention. Cold room 100 is a controlled temperature storage chamber for storing beer sources, such as beer sources 12 of FIG. 1. As shown, cold room 100 includes sections 102 and 104, separated by a partition 106. Section 102 includes beer sources Kl to Kn (which may be, without limitation, kegs or casks), and section 104 includes beer sources Cl to Cn (which may be, without limitation, casks or kegs). The wall 108 of the room 100, and the partition 106, may be, without limitation, an insulated panel wall, a brick or stone wall (for example the wall of a cellar), or any other wall. The partition 106 includes at least one fan 110 for blowing air from section 102 into section 104. Coolant chiller 20 may reside in the cold room 100.

Section 102 includes and air cooler 112 for maintaining the air temperature within section 102 within a desired temperature range. Air cooler 112 may be, without limitation, an air conditioning system controlled by a thermostat. Section 104 includes a sensor 114 for sensing temperature with section 104. Sensor 114, which may be, without limitation, a thermostat, is coupled to fan 110 and causes fan (or fans) 110 to turn on when the temperature within section 104 is outside of a desired temperature range. As an example of one set of temperatures for the cold room 100, without limitation, section 102 may be maintained at a temperature in the range of about 6° to about 8° Celsius, and section 104 may be maintained at a temperature in the range of about 11° to about 13° Celsius.

FIG. 7 illustrates one embodiment of a pre-cooler 29, which is a heat exchanger. The pre-cooler 29 illustrated in FIG. 7 is exemplary only, and any other pre-cooler may be used, including, without limitation, heat transfer fluid bath heat exchangers or cold plate heat exchangers. The particular pre-cooler 29 shown schematically in FIG. 7 is an in-line pre-cooler, which may be coupled in-line with a tube bundle used for carrying beer and coolant lines to the taps. The pre-cooler includes a housing 120, which may be made of, without limitation, plastic or metal, and is shaped as desired, but preferably with an elongated shape to run in-line with a tube bundle. Within the housing 120, a coolant line 122 is used to cool one or more beer lines 124. This cooling may be as described above in connection with any of the other embodiments. The coolant line 122 may run from the manifold 26, and return to manifold 28. The pre-cooling effected by pre-cooler 29 chills beer to desired temperatures for use within the system. Depending on the complexity of the system, pre-cooling may not be desired where a proper cold room is in place. Also, pre-cooling may diminish the need for a cold room.

Within this description, coupling includes both direct coupling of elements, and coupling indirectly through intermediate elements. Also, although various preferred embodiments of coolant flow are shown, coolant flow through more or fewer lines may be used.

The particular embodiments and descriptions provided herein are illustrative examples only, and features and advantages of each example may be interchanged with, or added to the features and advantages in the other embodiments and examples herein. Moreover, as examples, they are not meant to limit the scope of the present invention to any particular described detail, and the scope of the invention is meant to be broader than any example. For example, and without limitation, although beer applications have been illustrated, the present invention may be used with any other drink, including, without limitation, soft drinks (carbonated and noncarbonated), juices, milk, and tea. Also, the present invention has several aspects, as described above, and they may stand alone, or be combined with some or all of the other aspects.

And, in general, although the present invention has been described in detail, it should be understood that various changes, alterations, substitutions, additions and modifications can be made without departing from the intended scope of the invention, as defined in the following claims.

What is claimed is:

1. A beer system, comprising:

a plurality of beer sources;

a coolant chiller for chilling coolant, the chilled coolant being directed in a stream that is split to flow in at least a first coolant line and a second coolant line, the first coolant line coupled to a first coolant valve for controlling flow of coolant in the first coolant line;

a first beer tap for dispensing beer within a first temperature range, this first temperature range tap being coupled to at least one of the beer sources through a first beer line that runs, at least for some distance, in a bundle with the first and second coolant lines;

a first sensor for measuring the temperature of the beer to be dispensed by the first temperature range tap, the sensor providing a signal for use in controlling the first coolant valve;

a second beer tap for dispensing beer within a second temperature range, this second temperature range tap being coupled to a first heat exchanger, the first heat exchanger coupled between at least one of the beer sources and the second temperature range tap, the first heat exchanger also coupled to the second coolant line, the first heat exchanger operable to chill the beer received through a second beer line running from the coupled beer source before it reaches the second temperature range tap;

a second sensor for measuring the temperature of the beer chilled by the first heat exchanger; and a second coolant valve coupled to the second coolant line between the coolant chiller and the first heat exchanger for controlling flow of coolant to the first heat exchanger, the second coolant valve controlled in response to the second sensor.

2. The beer system of claim 1, wherein the first and second sensors are thermocouples.

3. The beer system of claim 1, wherein the first heat exchanger is a cold plate.

4. The beer system of claim 3, wherein the cold plate is cooled by a heat transfer fluid flowing through the cold plate.

5. The beer system of claim 1, and further comprising:

a third beer line coupled to one of the beer sources, the third beer line branching into a first branch and a second branch such that each branch carries the same beer brand;

a third beer tap for dispensing beer at at least two temperatures, the third beer tap being coupled to the first branch and the second branch a second heat exchanger coupled to the first branch between the beer source and the third beer tap, the second heat exchanger also coupled to the second coolant line, the second heat exchanger operable to chill the beer in the first branch before it reaches the third beer tap;

a third sensor for measuring the temperature of the beer chilled by the second heat exchanger;

a third coolant valve coupled to the second coolant line between the coolant chiller and the second heat exchanger for controlling flow of coolant to the second heat exchanger, the third coolant valve controlled in response to the third sensor; and a selector for selecting which of the two branches supplies beer to the third beer tap.

6. The beer system of claim 5, wherein the second branch runs outside of the second heat exchanger.

7. The beer system of claim 5, wherein a part of the second branch runs inside the second heat exchanger such that beer in the second branch is chilled by the second heat exchanger to a temperature that is higher than the temperature to which beer in the first branch is chilled.

8. The beer system of claim 5, wherein the third tap is coupled to the first and second branches through a three-way valve having two inputs and one output, wherein one input is coupled to the first branch downstream of the second heat exchanger, the other input is coupled to the second branch, and the output is coupled to the third beer tap, and wherein the three-way valve is controlled in response to the selector.

9. The beer system of claim 5, wherein the selector is a switch.

10. The beer system of claim 5, wherein at least part of the second heat exchanger is located within a beer font, and wherein the third beer tap is coupled to the beer font.

11. The beer system of claim 1, wherein the chilled coolant stream is split to flow also in a third coolant line, and further comprising:

a refrigerator coupled to the third coolant line such that coolant in the third coolant line effects chilling in the refrigerator;

a fourth sensor for measuring temperature in the refrigerator; and a fourth coolant valve for controlling flow of coolant in the third coolant line, the fourth coolant valve controlled in response to the fourth sensor.

* * * * *